US009109344B2

(12) United States Patent
Iizuka et al.

(10) Patent No.: US 9,109,344 B2
(45) Date of Patent: Aug. 18, 2015

(54) WORKING MACHINE

(75) Inventors: Kouya Iizuka, Hiratsuka (JP); Satoru Nishimura, Hirakata (JP); Hiroshi Yoshida, Hirakata (JP); Hiroaki Inoue, Hirakata (JP)

(73) Assignee: KOMATSU LTD., Tokyo (JP)

( * ) Notice: Subject to any disclaimer, the term of this patent is extended or adjusted under 35 U.S.C. 154(b) by 732 days.

(21) Appl. No.: 13/321,599

(22) PCT Filed: May 19, 2010

(86) PCT No.: PCT/JP2010/058445

§ 371 (c)(1),
(2), (4) Date: Nov. 21, 2011

(87) PCT Pub. No.: WO2010/137506

PCT Pub. Date: Dec. 2, 2010

(65) Prior Publication Data

US 2012/0060487 A1 Mar. 15, 2012

(30) Foreign Application Priority Data

May 29, 2009 (JP) ..... 2009-131142

(51) Int. Cl.

| | |
|---|---|
| ***E02F 9/22*** | (2006.01) |
| ***E02F 9/20*** | (2006.01) |
| ***F15B 11/17*** | (2006.01) |

(52) U.S. Cl.

CPC ..... *E02F 9/2004* (2013.01); *E02F 9/2228* (2013.01); *E02F 9/2282* (2013.01); *E02F 9/2285* (2013.01); *E02F 9/2292* (2013.01);

(Continued)

(58) Field of Classification Search

CPC .. F15B 2211/325; F15B 21/047; F15B 11/17; F15B 2211/324; F15B 2211/526; E02F 9/2004; E02F 9/2292; E02F 9/2228; E02F 9/2282; E02F 9/2285

USPC ..... 60/453; 91/461

See application file for complete search history.

(56) References Cited

U.S. PATENT DOCUMENTS 5,394,697 A * 3/1995 Hirata ..... 60/426
5,784,944 A 7/1998 Tozawa et al.

(Continued)

FOREIGN PATENT DOCUMENTS

CN 1970901 A 5/2007
EP 1813821 A1 * 8/2007

(Continued)

OTHER PUBLICATIONS

German Office Action, issued on Sep. 27, 2013 for the corresponding German patent application No. 112010002285.2.

(Continued)

*Primary Examiner* — Nathaniel Wiehe
*Assistant Examiner* — Abiy Teka
(74) *Attorney, Agent, or Firm* — Global IP Counselors, LLP

(57) ABSTRACT

In the working machine, first and second pilot flow paths are directly or indirectly connected to a tank flow path (52). A first restrictor is disposed between the first pilot flow path and the tank flow path. A second restrictor is disposed between the second pilot flow path and the tank flow path. An actuator control unit is configured to control an actuator based on a hydraulic pressure detected by a first hydraulic pressure detector unit and that detected by a second hydraulic pressure detector unit sensor.

4 Claims, 5 Drawing Sheets

(52) U.S. Cl.
CPC ..... *F15B 11/17* (2013.01); *F15B 2211/324* (2013.01); *F15B 2211/526* (2013.01)

(56) References Cited

U.S. PATENT DOCUMENTS

| | | | | |
|---|---|---|---|---|
| 2007/0125226 | A1 * | 6/2007 | Komiyama et al. | 91/459 |
| 2007/0277883 | A1 | 12/2007 | Asakage et al. | |

FOREIGN PATENT DOCUMENTS

| | | | | |
|---|---|---|---|---|
| JP | 409126203 | A | * | 5/1997 |
| JP | 2002-5109 | A | | 1/2002 |
| JP | 2005-195085 | A | | 7/2005 |
| JP | 2007-139146 | A | | 6/2007 |
| JP | 2007-139146 | A | | 6/2007 |
| JP | 2007-255468 | A | | 10/2007 |
| JP | 2009-236236 | A | | 10/2009 |

OTHER PUBLICATIONS

The Chinese Office Action for the corresponding Chinese application No. 201080023197.0, issued on Jan. 24, 2014.

International Search Report of corresponding PCT Application No. PCT/JP2010/058445.

* cited by examiner

WORKING MACHINE

CROSS-REFERENCE TO RELATED APPLICATIONS

This national phase application claims priority to Japanese Patent Application No. 2009-131142 filed on May 29, 2009. The entire disclosure of Japanese Patent Application No. 2009-131142 is hereby incorporated herein by reference.

TECHNICAL FIELD

The present invention relates to a working machine.

BACKGROUND ART

The working machines are normally embedded with an operating device for operating and controlling an actuator. The operating device includes an operating member to be operated by an operator. The action of the actuator is controlled in response to an operation of the operating member. For example, a hydraulic excavator described in Japan Laid-open Patent Application Publication No. JP-A-2007-139146 includes a lower travelling unit, an upper revolving unit disposed on the lower travelling unit, and a revolving motor functioning as an actuator for revolving the upper revolving unit. The revolving motor is herein controlled in response to the operating direction and the operating amount of a lever of an operating device.

FIG. 5 represents the schematic configuration of the aforementioned operating device. In the operating device, either a first pilot pressure control valve 82 or a second pilot pressure control valve 83 is selected in response to the operating direction of an operating lever 81. The selected one of the first and second pilot pressure control valves 82 and 83 is configured to allow the hydraulic fluid to flow between a hydraulic fluid flow path 84 and a pilot hydraulic source 85, regulate the pressure of the hydraulic fluid from the pilot hydraulic source 85 in accordance with the operating amount of the operating lever 81, and output the regulated hydraulic fluid. Meanwhile, the other unselected one of the first and second pilot pressure control valves 82 and 83 is configured to allow the hydraulic fluid to flow between the hydraulic fluid flow path 84 and a tank 86. A pressure sensor 87 is configured to detect the hydraulic pressure in one of the operating flow paths 84, while a pressure sensor 88 is configured to detect the hydraulic pressure in the other of the operating flow paths 84. The hydraulic fluid flow paths 84 are herein connected through a restrictor 89. Further, a controller 90 is configured to control a revolving motor 91 based on the hydraulic pressures detected by the pressure sensors 88 and 88.

In the aforementioned operating device, the hydraulic fluid to be outputted from the first pilot pressure control valve 82 flows into the pressure sensor 87 through the hydraulic fluid flow path 84. So-called air entrapment may herein occur when the hydraulic fluid flow paths 84 are herein dead-ended at the pressure sensors 87 and 88. The air entrapment is a phenomenon that air contained in the hydraulic fluid resides in front of the pressure sensor 87. When air entrapment occurs, detection performance of the pressure sensor 87 may be deteriorated. In the aforementioned operating device, however, the hydraulic fluid flow paths 84 are connected through the restrictor 89. Further, when selected through the operation of the operating lever 81, the second pilot pressure control valve 83 is configured to connect the hydraulic fluid flow path 84 to the tank 86. The air, contained in the hydraulic fluid supplied to the hydraulic fluid flow path 84 from the first pilot pressure control valve 82, is thereby directed towards the tank 86 through the restrictor 89, the hydraulic fluid flow path 84 and the second pilot pressure control valve 83. When the second pilot pressure control valve 83 is selected, by contrast, the air, contained in the hydraulic fluid supplied to the hydraulic fluid flow path 84 from the second pilot pressure control valve 83, is directed towards the tank 86 through the restrictor 89, the hydraulic fluid flow path 84 and the first pilot pressure control valve 82.

SUMMARY

However, the aforementioned operating device has a drawback that the air flows through a long flow path to reach the tank. In other words, it takes long time for the air to reach the tank. When the operating lever is herein switched in a short time period, the flow direction of the hydraulic fluid is switched before the air reaches the tank. When the operating lever is repeatedly switched back and forth in a short time period, the air contained in the hydraulic fluid may reciprocate among one of the hydraulic fluid paths, the restrictor and the other of the hydraulic fluid paths, and may be prevented from reaching the tank. It is herein assumed to boost the hydraulic fluid flow by increasing the flow amount of the restrictor in order to reduce a period of time required for the air to reach the tank. In this case, however, the flow amount of the hydraulic fluid will be unduly increased and this may reduce efficiency of the hydraulic source (e.g., a hydraulic pump).

It is an object of the present invention to provide a working machine for inhibiting occurrence of air entrapment even when an operating member is repeatedly switched in a short time period.

A working machine according to a first aspect of the present invention includes an actuator, a hydraulic pump configured to discharge a hydraulic fluid, a pump flow path connected to the hydraulic pump, a tank configured to contain the hydraulic fluid, a tank flow path connected to the tank, an operating member, a first pilot pressure control unit, a second pilot pressure control unit, a first pilot flow path, a second pilot flow path, a first hydraulic pressure detector unit, a second hydraulic pressure detector unit, a communicating flow path, a first restrictor, a second restrictor and an actuator control unit.

The first pilot pressure control unit includes a first pump port connected to the pump flow path, a first tank port connected to the tank flow path, and a first supply/discharge port. The first pilot pressure control unit is configured to be switched between an output state and a discharge state in accordance with an operation of the operating member. The first pilot pressure control unit in the output state causes the hydraulic fluid to flow between the first pump port and the first supply/discharge port for outputting from the first supply/discharge port the hydraulic fluid of a pressure in accordance with an operating amount of the operating member. The first pilot pressure control unit in the discharge state causes the hydraulic fluid to flow between the first tank port and the first supply/discharge port.

The second pilot pressure control unit includes a second pump port connected to the pump flow path, a second tank port connected to the tank flow path, and a second supply/discharge port. The second pilot pressure control unit is configured to be in an output state when the first pilot pressure control unit is in the discharge state. The second pilot pressure control unit in the output state causes the hydraulic fluid to flow between the second pump port and the second supply/discharge port for outputting from the second supply/discharge port the hydraulic fluid of a pressure in accordance with the operating amount of the operating member. The second pilot pressure control unit is configured to be in a discharge state when the first pilot pressure control unit is in the output state. The second pilot pressure control unit in the discharge state causes the hydraulic fluid to flow between the second tank port and the second supply/discharge port.

The first pilot flow path is connected to the first supply/discharge port. The second pilot flow path is connected to the second supply/discharge port. The first hydraulic pressure detector unit is configured to detect a hydraulic pressure in the first pilot flow path. The second hydraulic pressure detector unit is configured to detect a hydraulic pressure in the second pilot flow path. The communicating flow path is connected to the tank flow path and causes the hydraulic fluid to flow between the first pilot flow path and the second pilot flow path. The first restrictor is disposed between the first pilot flow path and the communicating flow path. The second restrictor is disposed between the second pilot flow path and the communicating flow path. The actuator control unit is configured to control the actuator based on the hydraulic pressure detected by the first hydraulic pressure detector unit and the hydraulic pressure detected by the second hydraulic pressure detector unit.

A working machine according to a second aspect of the present invention includes an actuator, a hydraulic pump configured to discharge a hydraulic fluid, a pump flow path connected to the hydraulic pump, a tank configured to contain the hydraulic fluid, a tank flow path connected to the tank, an operating member, a first pilot pressure control unit, a second pilot pressure control unit, a first pilot flow path, a second pilot flow path, a first hydraulic pressure detector unit, a second hydraulic pressure detector unit, a first restrictor, a second restrictor and an actuator control unit.

The first pilot pressure control unit includes a first pump port connected to the pump flow path, a first tank port connected to the tank flow path, and a first supply/discharge port. The first pilot pressure control unit is configured to be switched between an output state and a discharge state in accordance with an operation of the operating member. The first pilot pressure control unit in the output state causes the hydraulic fluid to flow between the first pump port and the first supply/discharge port for outputting from the first supply/discharge port the hydraulic fluid of a pressure in accordance with an operating amount of the operating member. The first pilot pressure control unit in the discharge state causes the hydraulic fluid to flow between the first tank port and the first supply/discharge port.

The second pilot pressure control unit includes a second pump port connected to the pump flow path, a second tank port connected to the tank flow path, and a second supply/discharge port. The second pilot pressure control unit is configured to be in an output state when the first pilot pressure control unit is in the discharge state. The second pilot pressure control unit in the output state causes the hydraulic fluid to flow between the second pump port and the second supply/discharge port for outputting from the second supply/discharge port the hydraulic fluid of a pressure in accordance with the operating amount of the operating member. The second pilot pressure control unit is configured to be in a discharge state when the first pilot pressure control unit is in the output state. The second pilot pressure control unit in the discharge state causes the hydraulic fluid to flow between the second tank port and the second supply/discharge port.

The first pilot flow path is connected to the first supply/discharge port and the tank flow path. The second pilot flow path is connected to the second supply/discharge port and the tank flow path. The first hydraulic pressure detector unit is configured to detect a hydraulic pressure in the first pilot flow path. The second hydraulic pressure detector unit is configured to detect a hydraulic pressure in the second pilot flow path. The first restrictor is disposed between the first pilot flow path and the tank flow path. The second restrictor is disposed between the second pilot flow path and the tank flow path. The actuator control unit is configured to control the actuator based on the hydraulic pressure detected by the first hydraulic pressure detector unit and the hydraulic pressure detected by the second hydraulic pressure detector unit.

A working machine according to a third aspect of the present invention relates to the working machine according to one of the first and second aspects of the present invention. In the working machine, the actuator control unit is configured not to use the hydraulic pressure detected by either of the first and second hydraulic pressure detector units in order to control the actuator when the detected hydraulic pressure is equal to or less than a predetermined threshold.

ADVANTAGEOUS EFFECTS OF INVENTION

According to the working machine of the first aspect of the present invention, the communicating flow path allows the hydraulic fluid to flow between the first and second pilot flow paths. Further, the communicating flow path is connected to the tank flow path. With the structure, air contained in the hydraulic fluid flowing through the first pilot flow path can reach the tank through the communicating flow path and the tank flow path without flowing through the second pilot flow path and the second pilot pressure control unit. On the other hand, air contained in the hydraulic fluid flowing through the second pilot flow path can reach the tank through the communicating flow path and the tank flow path without flowing through the first pilot flow path and the first pilot pressure control unit. Therefore, the air contained in the hydraulic fluid flows through a short flow path until reaching the tank. In other words, it is possible to shorten a period of time required for the air to reach the tank. Accordingly, it is possible to inhibit occurrence of air entrapment even when the operating member is repeatedly switched in a short time period.

Further, the first restrictor is disposed between the first pilot flow path and the communicating flow path. It is thereby possible to inhibit impact of the hydraulic pressure in the tank flow path on the hydraulic pressure to be detected by the first hydraulic pressure detector unit. Yet further, the second restrictor is disposed between the second pilot flow path and the communicating flow path. It is thereby possible to inhibit impact of the hydraulic pressure in the tank flow path on the hydraulic pressure to be detected by the second hydraulic pressure detector unit. Accordingly, it is possible to enhance accuracy in detection of the hydraulic pressure by the first and second hydraulic pressure detector units.

According to the working machine of the second aspect of the present invention, the first pilot flow path is connected to the tank flow path through its corresponding restrictor while the second pilot flow path is connected to the tank flow path through its corresponding restrictor. With the structure, air contained in the hydraulic fluid flowing through the first pilot flow path can reach the tank through the tank flow path without flowing through the second pilot flow path and the second pilot pressure control unit. On the other hand, air contained in the hydraulic fluid flowing through the second pilot flow path can reach the tank through the tank flow path without flowing through the first pilot flow path and the first pilot pressure control unit. Therefore, the air contained in the hydraulic fluid flows through a short flow path until reaching the tank. In other words, it is possible to shorten a period of time required for the air to reach the tank. Accordingly, it is possible to inhibit occurrence of air entrapment even when the operating member is repeatedly switched in a short time period.

Further, the first restrictor is disposed between the first pilot flow path and the tank flow path. It is thereby possible to inhibit impact of the hydraulic pressure in the tank flow path on the hydraulic pressure to be detected by the first hydraulic pressure detector unit. Yet further, the second restrictor is disposed between the second pilot flow path and the tank flow path. It is thereby possible to inhibit impact of the hydraulic pressure in the tank flow path on the hydraulic pressure to be detected by the second hydraulic pressure detector unit. Accordingly, it is possible to enhance accuracy in detection of the hydraulic pressure by the first and second hydraulic pressure detector units.

According to the working machine of the third aspect of the present invention, even if air entrapment occurs, a value of the hydraulic pressure is not used for the control of the actuator when the value of the hydraulic pressure is detected to be lower than the actual hydraulic pressure due to the entrapped air. Therefore, the actuator can be stably controlled.

DESCRIPTION OF THE EMBODIMENTS

External Structure

Figure 1:
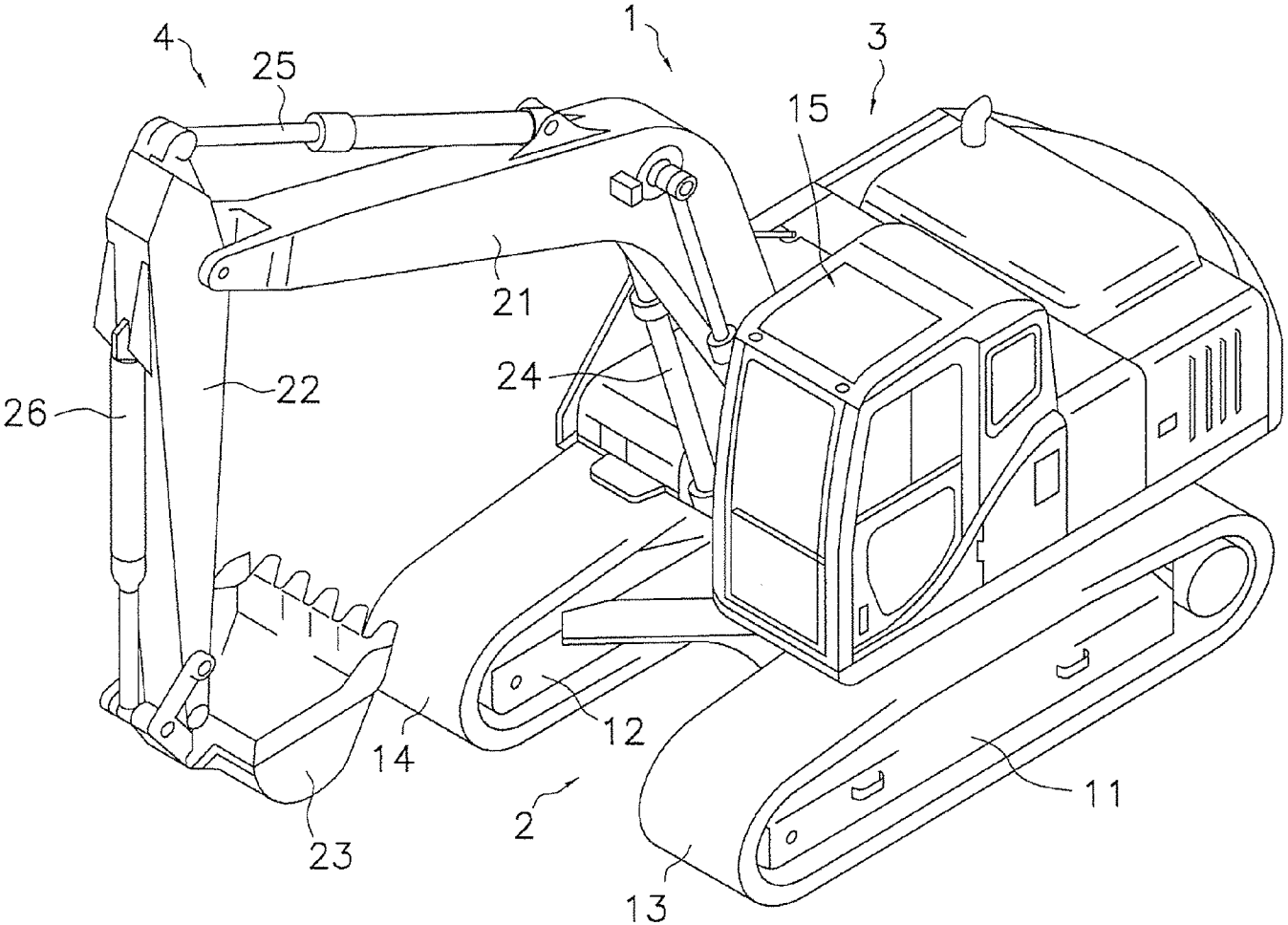
FIG. 1 is a perspective view of a hydraulic excavator according to an exemplary embodiment of the present invention.

FIG. 1 illustrates a hydraulic excavator 1 according to an exemplary embodiment of the present invention. The hydraulic excavator 1 includes a travelling unit 2, a revolving unit 3 and a working unit 4.

The travelling unit 2 includes a pair of drive units 11 and 12. The drive unit 11 includes a track (crawler belt) 13 and a drive motor 16 (see FIG. 2). Likewise, the drive unit 12 includes a track 14 and a drive motor 17 (see FIG. 2). The drive motors 16 and 17 are configured to drive the tracks 13 and 14 for causing the hydraulic excavator 1 to travel.

The revolving unit 3 is mounted on the travelling unit 2. The revolving unit 3 is configured to revolve on the travelling unit 2 by means of an electronic motor 18 (one example of an actuator) (see FIG. 2). Further, a cab 15 occupies the front left part of the revolving unit 3.

The working unit 4 is attached to the front center part of the revolving unit 3, and includes a boom 21, an arm 22 and a bucket 23. The base of the boom 21 is rotatably coupled to the revolving unit 3. On the other hand, the tip of the boom 21 is rotatably coupled to the base of the arm 22. The tip of the arm 22 is rotatably coupled to the bucket 23. Further, hydraulic cylinders (i.e., a boom cylinder 24, an arm cylinder 25 and a bucket cylinder 26) are respectively disposed to be paired with the boom 21, the arm 22 and the bucket 23. The working unit 4 is configured to be driven in conjunction with driving of the hydraulic cylinders 24 to 26. Accordingly, the hydraulic excavator 1 executes a variety of works such as excavation.

Hydraulic System Structure

Figure 2:
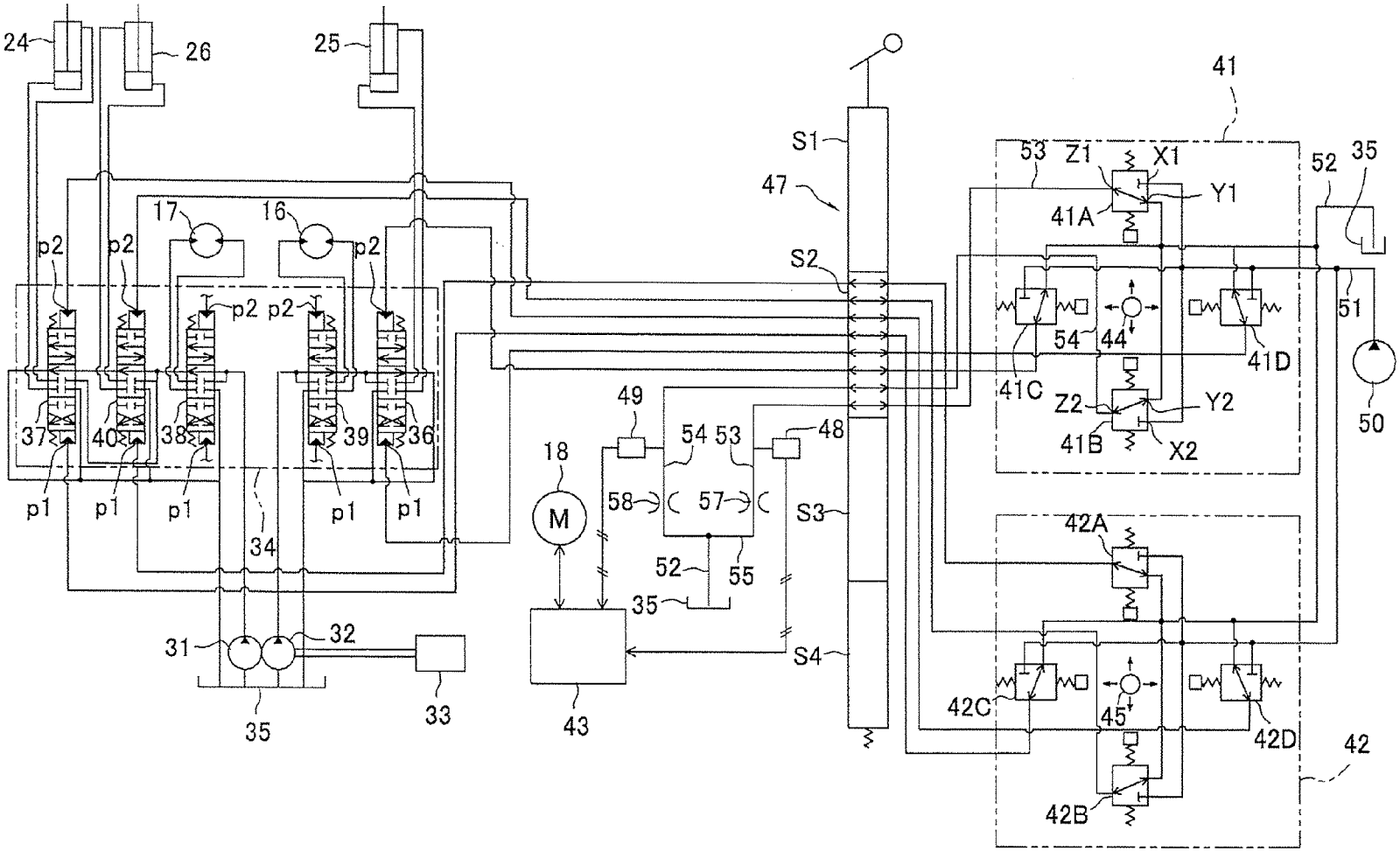
FIG. 2 is a schematic hydraulic circuit diagram of the hydraulic excavator.

Next, FIG. 2 represents the structure of a hydraulic system embedded in the hydraulic excavator 1. In the hydraulic system, a first hydraulic pump 31 and a second hydraulic pump 32 are configured to be driven by an engine 33. The first and second hydraulic pumps 31 and 32 function as driving sources for driving the boom cylinder 24, the arm cylinder 25, the bucket cylinder 26 and the drive motors 16 and 17.

The hydraulic fluid, discharged from the first and second hydraulic pumps 31 and 32, is supplied via an operating valve 34 to hydraulic actuators such as the boom cylinder 24, the arm cylinder 25, the bucket cylinder 26 and the drive motors 16 and 17. Further, the hydraulic fluid supplied to the hydraulic actuators is discharged to a tank 35 via the operating valve 34. Specifically, the operating valve 34 includes an arm operating valve 36, a boom operating valve 37, a left drive operating valve 38, a right drive operating valve 39 and a bucket operating valve 40. The arm operating valve 36 is configured to control supply of the hydraulic fluid to the arm cylinder 25 and discharge of the hydraulic fluid therefrom. The boom operating valve 37 is configured to control supply of the hydraulic fluid to the boom cylinder 24 and discharge of the hydraulic fluid therefrom. The left drive operating valve 38 is configured to control supply of the hydraulic fluid to the left-side drive motor 17 and discharge of the hydraulic fluid therefrom. The right drive operating valve 39 is configured to control supply of the hydraulic fluid to the right-side drive motor 16 and discharge of the hydraulic fluid therefrom. The bucket operating valve 40 is configured to control supply of the hydraulic fluid to the bucket cylinder 26 and discharge of the hydraulic fluid therefrom. Each of the arm operating valve 36, the boom operating valve 37, the left drive operating valve 38, the right drive operating valve 39 and the bucket operating valve 40 is provided with a pair of pilot ports p1 and p2. Each of the operating valves 36 to 40 is configured to be controlled by the hydraulic fluid of a predetermined pilot pressure supplied to each of the pilot ports p1 and p2. Further, the pilot pressures to be applied to the arm operating valve 36, the boom operating valve 37 and the bucket operating valve 40 are controlled in response to operations of a first operating lever device 41 and a second operating lever device 42 to be described. The pilot pressures to be applied to the left and right drive operating valves 38 and 39 are configured to be controlled in response to an operation of a drive lever device (not illustrated in the figures). Thus, the respective operating valves 36 to 40 are controlled for controlling actions of the working unit 4 and travelling actions of the travelling unit 2.

Further, in the hydraulic excavator 1, the revolving unit 3 is configured to revolve by means of the electronic motor 18. The electronic motor 18 is driven by means of electric power, and is controlled by an electric control signal from a controller 43 (one example of an actuator control unit). The controller 43 is configured to control the electronic motor 18 in response to operations of the first and second operating lever devices 41 and 42.

Operating Lever Device Structure

The following relates to detailed explanation of the first and second operating lever devices 41 and 42 and the structure of a hydraulic circuit related to the devices 41 and 42.

The first operating lever device 41 includes a first operating lever 44 (one example of an operating member) to be operated by an operator, a first pilot pressure control valve 41A (one example of a first pilot pressure control unit), a second pilot pressure control valve 41B (one example of a second pilot pressure control unit), a third pilot pressure control valve 41 c and a fourth pilot pressure control valve 41D. The second operating lever device 42 includes a second operating lever 45 to be operated by an operator, a fifth pilot pressure control valve 42A, a sixth pilot pressure control valve 42B, a seventh pilot pressure control valve 42C and an eighth pilot pressure control valve 42D. The first operating lever 44 is configured to be operated in four directions (i.e., front, rear, right and left directions). The first, second, third and fourth pilot pressure control valves 41A, 41B, 41C and 41D are provided for the four operating directions of the first operating lever 44 on a one-to-one basis. Similarly to the first operating lever 44, the second operating lever 45 is configured to be operated in four directions (i.e., front, rear, right and left directions). The fifth, sixth, seventh and eighth pilot pressure control valves 42A, 42B, 42C and 42D are provided for the four operating directions of the second operating lever 45 on a one-to-one basis. An operator is allowed to operate the first and second operating levers 44 and 45 for controlling actions of the working unit 4 and revolving actions of the revolving unit 3. Six of the pilot pressure control valves 41A to 41D and 42A to 42D are respectively connected to three pairs of the pilot ports p1 and p2 of the operating valves 36, 37 and 40 via a multivalve 47. Further, two of the pilot pressure control valves 41A to 41D and 42A to 42D are connected to hydraulic pressure sensors 48 and 49 to be described. The multivalve 47 is configured to be switched among four states of S1 to S4. In response to switching of the multivalve 47 into any one of the states S1 to S4, corresponding one is selected from the connection patterns among the pilot pressure control valves 41A to 41D and 42A to 42D and the pilot ports p1 and p2 of the operating valves 36, 37 and 40 and the hydraulic pressure sensors 48 and 49. Thus, an operator can set the correspondence between the operating directions of the first and second operating levers and the actions of the working unit and the revolving actions of the revolving unit to be desired patterns. The following relates to explanation of an exemplary case that the multivalve 47 is set to be in the state S2.

The first pilot pressure control valve 41A includes a first pump port X1, a first tank port Y1 and a first supply/discharge port Z1. The first pump port X1 is connected to a pump flow path 51. The pump flow path 51 is connected to a third hydraulic pump 50. The third hydraulic pump 50 is a pump provided separately from the aforementioned first and second hydraulic pumps 31 and 32. It should be noted that either of the first and second hydraulic pumps 31 and 32 may be herein used instead of the third hydraulic pump 50. The first tank port Y1 is connected to a tank flow path 52. The tank flow path 52 is connected to the tank 35 containing the hydraulic fluid. The first supply/discharge port Z1 is connected to a first pilot flow path 53. The first pilot pressure control valve 41A is configured to be switched between an output state and a discharge state in response to an operation of the first operating lever 44. In the output state, the first pilot pressure control valve 41A is configured to allow the hydraulic fluid to flow between the first pump port X1 and the first supply/discharge port Z1 in order to output the hydraulic fluid of a pressure in accordance with the operating amount of the first operating lever 44 from the first supply/discharge port Z1 to the first pilot flow path 53. In the discharge state, by contrast, the first pilot pressure control valve 41A is configured to allow the hydraulic fluid to flow between the first tank port Y1 and the first supply/discharge port Z1.

The second pilot pressure control valve 41B includes a second pump port X2, a second tank port Y2 and a second supply/discharge port Z2. The second pump port X2 is connected to the pump flow path 51. The second tank port Y2 is connected to the tank flow path 52. The second supply/discharge port Z2 is connected to a second pilot flow path 54. The second pilot pressure control valve 41B is configured to be switched between an output state and a discharge state in response to an operation of the first operating lever 44. In the output state, the second pilot pressure control valve 41B is configured to allow the hydraulic fluid to flow between the second pump port X2 and the second supply/discharge port Z2 in order to output the hydraulic fluid of a pressure in accordance with the operating amount of the first operating lever 44 from the second supply/discharge port Z2 to the second pilot flow path 54. In the discharge state, by contrast, the second pilot pressure control valve 41B is configured to allow the hydraulic fluid to flow between the second tank port Y2 and the second supply/discharge port Z2.

The hydraulic fluid is allowed to flow between the first and second pilot flow paths 53 and 54 via a communicating flow path 55. The communicating flow path 55 is connected to the tank flow path 52. Further, a first restrictor 57 is disposed between the first pilot flow path 53 and the communicating flow path 55. Yet further, a second restrictor 58 is disposed between the second pilot flow path 54 and the communicating flow path 55.

The first and second pilot pressure control valves 41A and 42B are herein paired and correspond to opposite operating directions of the first operating lever 44. For example, the first and second pilot pressure control valve 41A and 42B may respectively correspond to the forward and rearward operations of the first operating lever 44. Alternatively, the first and second pilot pressure control valves 41A and 41B may respectively correspond to the rightward and leftward operations of the first operating lever 44. Either of the first and second pilot pressure control valves 41A and 41B is configured to be selected in response to the operation of the first operating lever 44. Specifically, the second pilot pressure control valve 41B is set to be in the discharge state when the first pilot pressure control valve 41A is set to be in the output state. To the contrary, the second pilot pressure control valve 41B is set to be in the output state when the first pilot pressure control valve 41A is set to be in the discharge state.

The first hydraulic pressure sensor 48 (one example of a first hydraulic pressure detector unit) is configured to detect the pressure of the hydraulic fluid supplied to the first pilot flow path 53 via the first pilot pressure control valve 41A. The first hydraulic pressure sensor 48 is then configured to output an electric detection signal to the controller 43 in accordance with the detected pressure of the hydraulic fluid. On the other hand, the second hydraulic pressure sensor 49 (one example of a second hydraulic pressure detector unit) is configured to detect the pressure of the hydraulic fluid supplied to the second pilot flow path 54 via the second pilot pressure control valve 41B. The second hydraulic pressure sensor 49 is then configured to output an electric detection signal to the controller 43 in accordance with the detected pressure of the hydraulic fluid.

The controller 43 is configured to control the electronic motor 18 based on the hydraulic pressure detected by the first hydraulic pressure sensor 48 and that detected by the second hydraulic pressure sensor 49. Specifically, the controller 43 is configured to rotationally drive the electronic motor 18 in opposite directions for the cases that the first hydraulic pressure sensor 48 detects the hydraulic pressure and that the second hydraulic pressure sensor 49 detects the hydraulic pressure. Further, the controller 43 is configured to regulate the revolving speed in accordance with the magnitude of the detected hydraulic pressure. Put the above together, the revolving direction and the revolving speed of the revolving unit 3 are controlled in accordance with the operating direction and the operating amount of the first operating lever 44. It should be noted that the controller 43 is configured not to use the hydraulic pressure detected by either the first hydraulic pressure sensor 48 or the second hydraulic pressure sensor 49 for controlling the electronic motor 18 when the detected hydraulic pressure is equal to or less than a predetermined threshold. In other words, the controller 43 is configured to control the electronic motor 18 based on a value of the hydraulic pressure greater than the threshold. It is thereby possible to prevent the electronic motor 18 from performing unexpected actions in conjunction with erroneous detections by the hydraulic pressure sensors 48 and 49.

Similarly to the aforementioned first and second pilot pressure control valves 41A and 41B, the third and fourth pilot pressure control valves 41C and 41D are paired, and either of them is configured to be selected in accordance with an operation of the first operating lever 44. The structures of the third and fourth pilot pressure control valves 41C and 41D are the same as those of the first and second pilot pressure control valves 41A and 41B. The third pilot pressure control valve 41C is configured to control supply of the hydraulic fluid to the second pilot port p2 of the arm operating valve 36 and discharge of the operation oil therefrom. The fourth pilot pressure control valve 41D is configured to control supply of the hydraulic fluid to the first pilot port p1 of the aim operating valve 36 and discharge of the hydraulic fluid therefrom. Accordingly, supply of the hydraulic fluid to the aim cylinder 25 and discharge of the hydraulic fluid therefrom are controlled in accordance with the operation of the first operating lever 44. Extension and contraction of the arm cylinder 25 are thereby controlled.

The structures of the fifth pilot pressure control valve 42A, the sixth pilot pressure control valve 42B, the seventh pilot pressure control valve 42C and the eighth pilot pressure control valve 42D are respectively the same as those of the first pilot pressure control valve 41A, the second pilot pressure control valve 41B, the third pilot pressure control valve 41C and the fourth pilot pressure control valve 41D. The fifth and sixth pilot pressure control valves 42A and 42B are herein paired, and either of them is configured to be selected in response to an operation of the second operating lever 45. Likewise, the seventh and eighth pilot pressure control valves 42C and 42D are paired, and either of them is configured to be selected in response to an operation of the second operating lever 45. The fifth pilot pressure control valve 42A is configured to control supply of the hydraulic fluid to the first pilot port p1 of the bucket operating valve 40 and discharge of the hydraulic fluid therefrom. The sixth pilot pressure control valve 42B is configured to supply the hydraulic fluid to the second pilot port p2 of the bucket operating valve 40 and the discharge of the hydraulic fluid therefrom. Accordingly, supply of the hydraulic fluid to the bucket cylinder 26 and discharge of the hydraulic fluid therefrom are controlled in accordance with the operation of the second operating lever 45. Extension and contraction of the bucket cylinder 26 are thereby controlled. Further, the seventh pilot pressure control valve 42C is configured to control supply of the hydraulic fluid to the first pilot port p1 of the boom operating valve 37 and discharge of the hydraulic fluid therefrom. The eighth pilot pressure control valve 42D is configured to control supply of the hydraulic fluid to the second pilot port p2 of the boom operating valve 37 and discharge of the hydraulic fluid therefrom. Accordingly, supply of the hydraulic fluid to the boom cylinder 24 and discharge of the hydraulic fluid therefrom are controlled in accordance with the operation of the second operating lever 45. Extension and contraction of the boom cylinder 24 are thereby controlled.

Control Related to Operation of Electronic Motor 18

Figure 3:
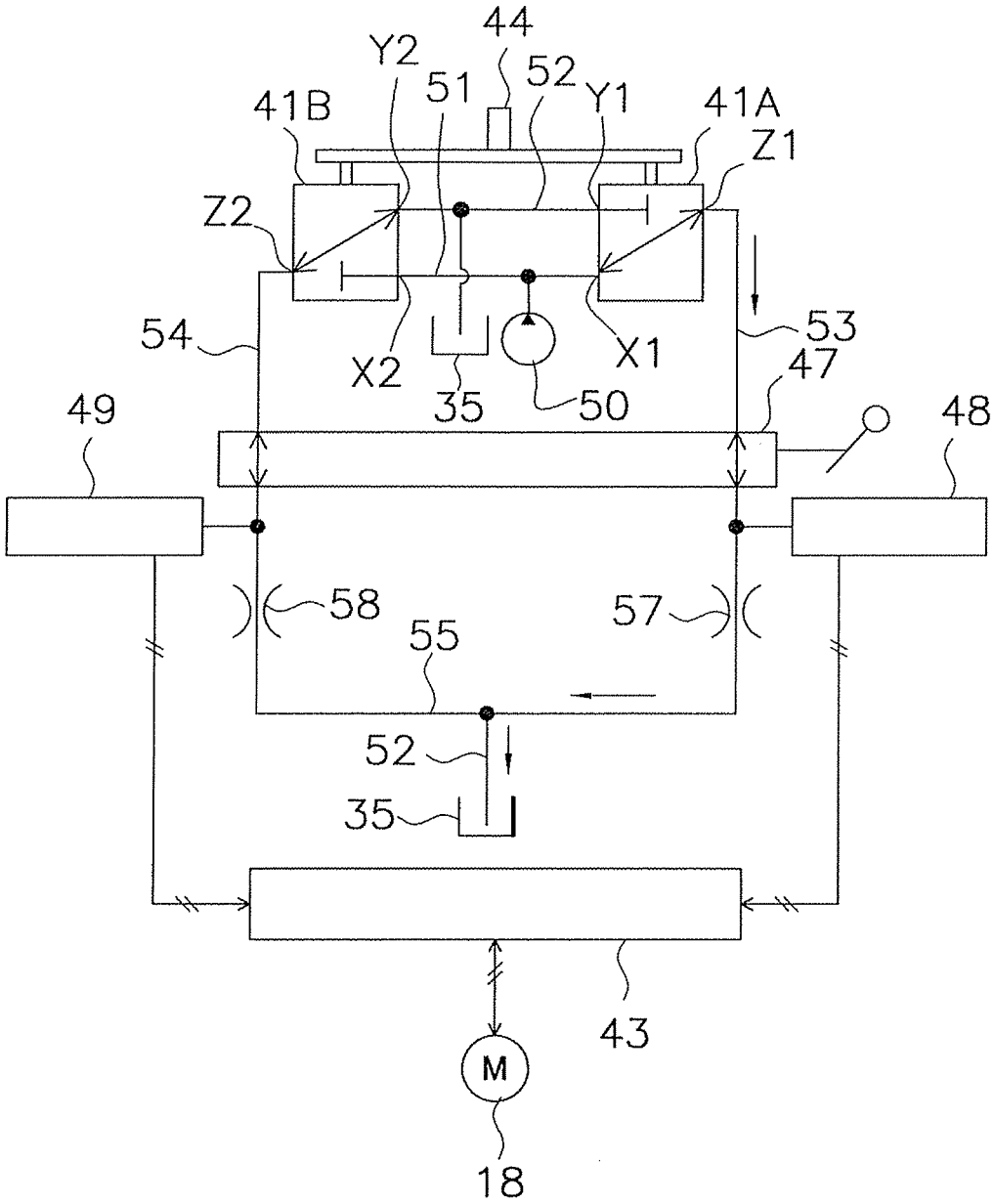
FIG. 3 is a simplified hydraulic circuit diagram focused on an operation of a revolving motor.

FIG. 3 represents a simplified hydraulic circuit diagram comprised of components related to the operation of the electronic motor 18, and these components are selectively picked up from the components represented in the hydraulic circuit diagram of FIG. 2. With reference to FIG. 3, the control related to the operation of the electronic motor 18 will be hereinafter explained in detail.

When the first operating lever 44 is tilted in a given direction (e.g., the right direction), the first pilot pressure control valve 41A is set to be in the output state while the second pilot pressure control valve 41B is set to be in the discharge state. Accordingly, the pump flow path 51 is connected to the first pilot flow path 53 through the first supply/discharge port Z1. Further, the tank flow path 52 is connected to the second pilot flow path 54 through the second supply/discharge port Z2. Therefore, the hydraulic fluid discharged from the third hydraulic pump 50 is supplied to the first pilot flow path 53, and the first hydraulic pressure sensor 48 detects the hydraulic pressure in the first pilot flow path 53. The hydraulic pressure detected by the first hydraulic pressure sensor 48 is converted into a detection signal and is outputted to the controller 43. The controller 43 controls the electronic motor 18 based on the detection signal. The hydraulic fluid supplied to the first pilot flow path 53 flows towards the tank 35 via the first restrictor 57, the communicating flow path 55 and the tank flow path 52, and is recovered by the tank 35. It should be noted that the hydraulic fluid in the second pilot flow path 54 flows towards the tank 35 via the second supply/discharge port Z2 and the tank flow path 52, and is recovered by the tank 35.

When air is contained in the hydraulic fluid flowing through the communicating flow path 55, the air is immediately discharged through the tank flow path 52. When air is contained in the hydraulic fluid flowing through the first pilot flow path 53, air is discharged through the first restrictor 57, the communicating flow path 55 and the tank flow path 52. When air is contained in the hydraulic fluid flowing through the second pilot flow path 54, the air is discharged through the second pilot pressure control valve 41B and the tank flow path 52.

Next, when the first operating lever 44 is tilted in a direction opposite to the aforementioned direction (e.g., the left direction), the first pilot pressure control valve 41A is set to be in the discharge state while the second pilot pressure control valve 41B is set to be in the output state. Accordingly, the pump flow path 51 is connected to the second pilot flow path 54 through the second supply/discharge port Z2. Further, the tank flow path 52 is connected to the first pilot flow path 53 through the first supply/discharge port Z1. Therefore, the hydraulic fluid discharged from the third hydraulic pump 50 is supplied to the second pilot flow path 54, and the second hydraulic pressure sensor 49 detects the hydraulic pressure in the second pilot flow path 54. The hydraulic pressure detected by the second hydraulic pressure sensor 49 is converted into a detection signal and is outputted to the controller 43. The controller 43 controls the electronic motor 18 based on the detection signal. The hydraulic fluid supplied to the second pilot flow path 54 flows towards the tank 35 via the second restrictor 58, the communicating flow path 55 and the tank flow path 52, and is recovered by the tank 35. It should be noted that the hydraulic fluid in the first pilot flow path 53 flows towards the tank 35 via the first supply/discharge port Z1 and the tank flow path 52, and is recovered by the tank 35.

When air is contained in the hydraulic fluid flowing through the communicating flow path 55, the air is immediately discharged through the tank flow path 52. When air is contained in the hydraulic fluid flowing through the second pilot flow path 54, the air is discharged through the second restrictor 58, the communicating flow path 55 and the tank flow path 52. When air is contained in the hydraulic fluid flowing through the first pilot flow path 53, the air is discharged through the first pilot pressure control valve 41A and the tank flow path 52.

As described above, the air contained in the hydraulic fluid flows through a short flow path until discharged. In other words, the air can be discharged in a short time period. Therefore, occurrence of air entrapment can be inhibited. Further, the air can be herein discharged in a short time period, and it is not thereby required to increase the flow amounts of the first and second restrictor 57 and 58 in order to increase the flow speed of the hydraulic fluid. Therefore, efficiency of the third hydraulic pump 50 can be enhanced without unnecessarily increasing the flow amount of the hydraulic fluid.

Other Exemplary Embodiments (a) In the aforementioned exemplary embodiment, two restrictors (i.e., the first and second restrictors 57 and 58) are provided. However, only a single restrictor 59 may be disposed between the communicating flow path 55 and the tank flow path 52.

Figure 4:
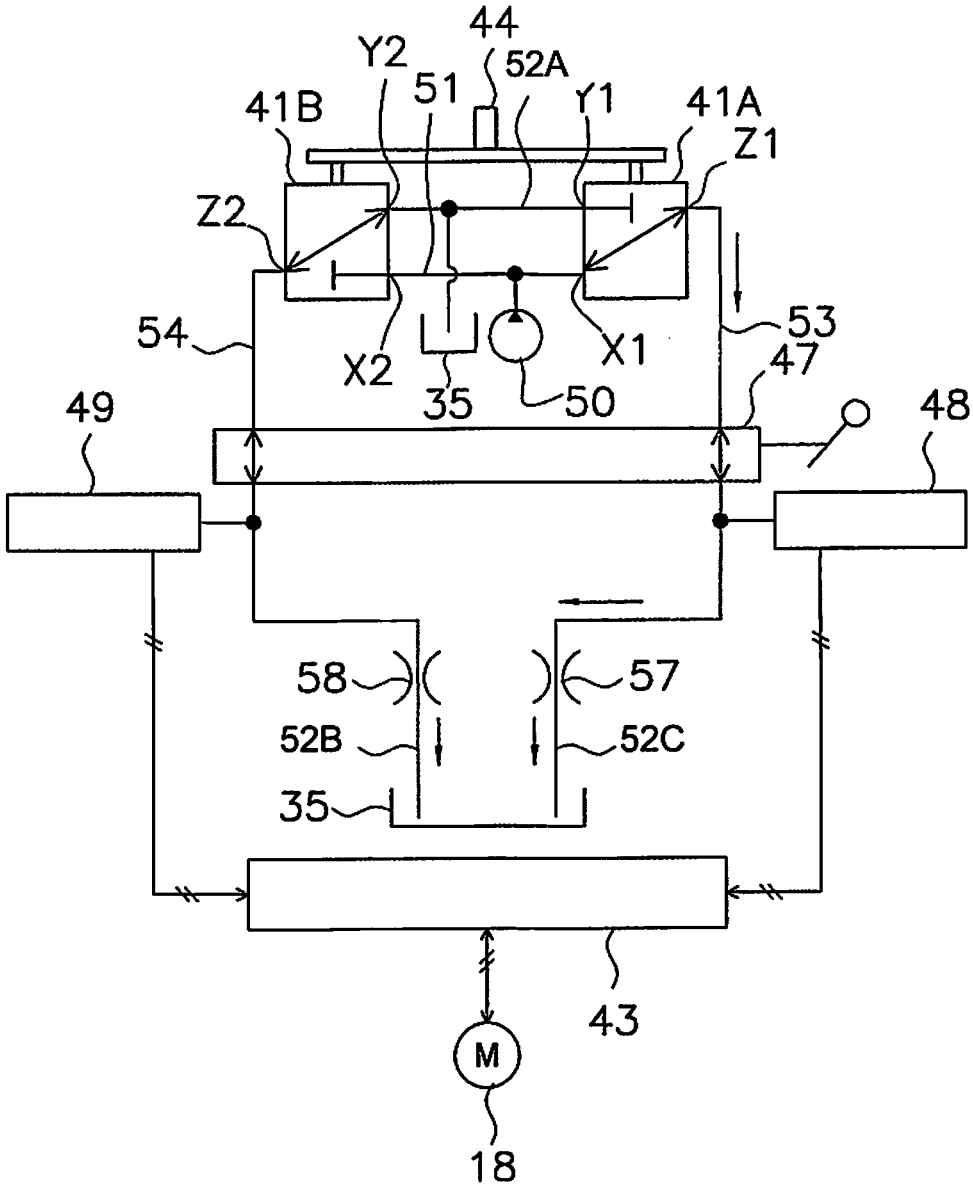
FIG. 4 is a hydraulic circuit diagram according to another exemplary embodiment of the present invention.
Figure 5:
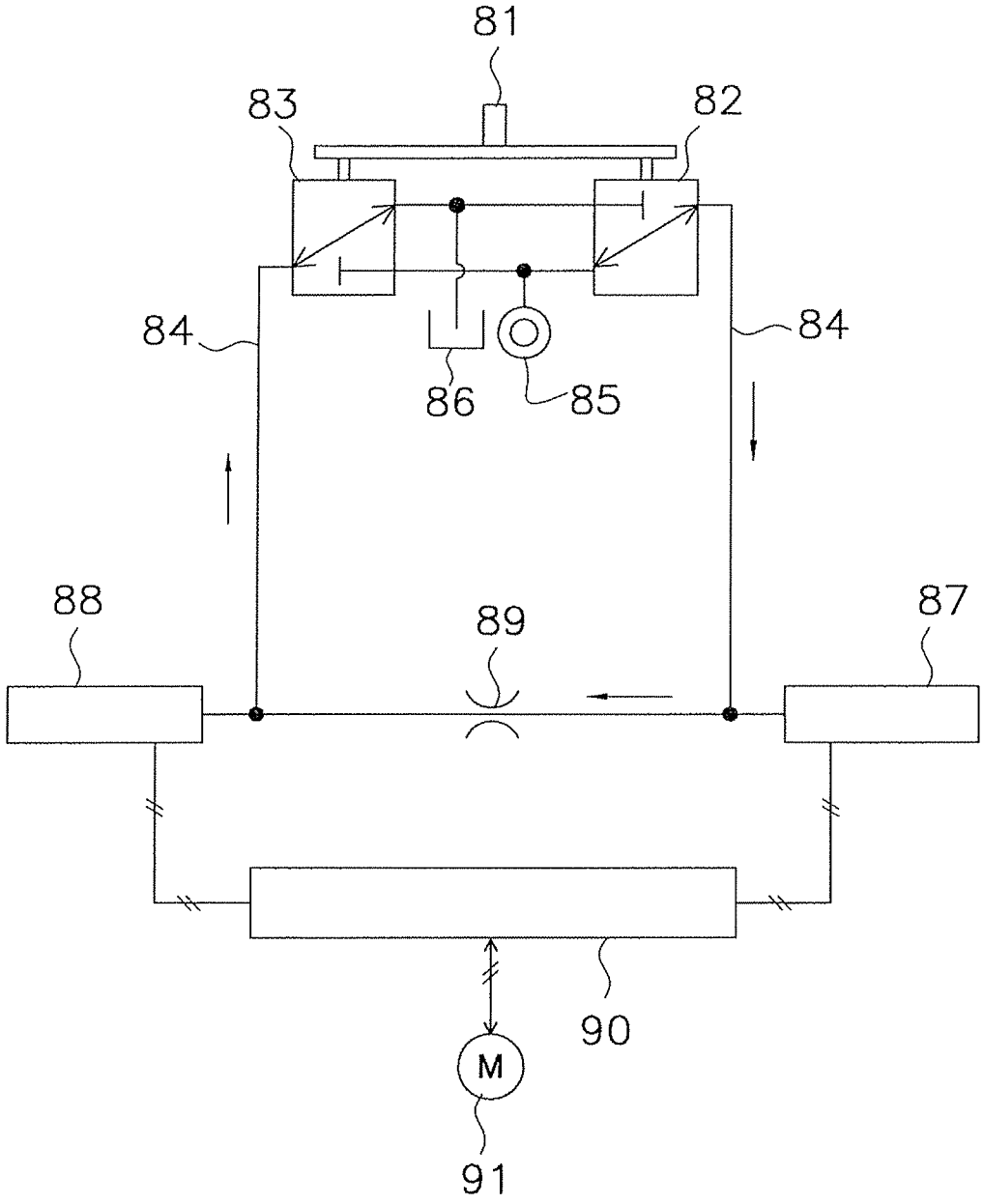
FIG. 5 is a simplified hydraulic circuit diagram of a well-known working machine.

(b) In the aforementioned exemplary embodiment, the hydraulic fluid is allowed to flow between the first and second pilot flow paths 53 and 54 through the communicating flow path 55. However, the first and second pilot flow paths 53 and 54 may be connected to separate tank flow paths 52B and 52C without being connected, as represented in FIG. 4. In this case, the first restrictor 57 is disposed between the first pilot flow path 53 and the second tank flow path 52B, while the second restrictor 58 is disposed between the second pilot flow path 54 and the third tank flow path 52C. Additionally, in this embodiment, the first and second tank ports Y1 and Y2 are connected to a first tank flow path 52A.

(c) In the aforementioned exemplary embodiment, the electronic motor 18 is used as an actuator for revolving. However, the electronic motor 18 may be used as an actuator for any other purpose.

(d) In the aforementioned exemplary embodiment, the first operating lever device 41 is used for both operations of the working unit 4 and the revolving unit 3. However, different operating devices may be used for the operations of the working unit 4 and the revolving unit 3. Further, the operating member is not limited to be of a lever type and may be of any other type.

The working machine of any of the illustrated embodiments can achieve an advantageous effect of inhibiting occurrence of air entrapment even when an operating member is repeatedly switched in a short time period. Therefore, the present invention is useful as the working machines.

The invention claimed is:

1. A working machine comprising:

an actuator;

a hydraulic pump configured to discharge a hydraulic fluid;

a pump flow path connected to the hydraulic pump;

a tank configured to contain the hydraulic fluid;

a tank flow path connected to the tank;

an operating member;

a first pilot pressure control unit including a first pump port connected to the pump flow path, a first tank port connected to the tank flow path, and a first supply/discharge port, the first pilot pressure control unit being configured to be switched between an output state and a discharge state in accordance with an operation of the operating member, the first pilot pressure control unit in the output state causing the hydraulic fluid to flow between the first pump port and the first supply/discharge port for outputting from the first supply/discharge port the hydraulic fluid of a pressure in accordance with an operating amount of the operating member, the first pilot pressure control unit in the discharge state causing the hydraulic fluid to flow between the first tank port and the first supply/discharge port;

a second pilot pressure control unit including a second pump port connected to the pump flow path, a second tank port connected to the tank flow path, and a second supply/discharge port, the second pilot pressure control unit being configured to be in an output state when the first pilot pressure control unit is in the discharge state, the second pilot pressure control unit in the output state causing the hydraulic fluid to flow between the second pump port and the second supply/discharge port for outputting from the second supply/discharge port the hydraulic fluid of a pressure in accordance with the operating amount of the operating member, the second pilot pressure control unit being configured to be in a discharge state when the first pilot pressure control unit is in the output state, the second pilot pressure control unit in the discharge state causing the hydraulic fluid to flow between the second tank port and the second supply/discharge port;

a first pilot flow path connected to the first supply/discharge port;

a second pilot flow path connected to the second supply/discharge port;

a first hydraulic pressure detector unit that is connected to the first pilot flow path and configured to detect a hydraulic pressure in the first pilot flow path;

a second hydraulic pressure detector unit that is connected to the second pilot flow path and configured to detect a hydraulic pressure in the second pilot flow path;

a communicating flow path connected to the tank flow path, the communicating flow path causing the hydraulic fluid to flow between the first pilot flow path and the second pilot flow path;

a first restrictor disposed between the first pilot flow path and the communicating flow path;

a second restrictor disposed between the second pilot flow path and the communicating flow path; and an actuator control unit configured to control the actuator based on the hydraulic pressure detected by the first hydraulic pressure detector unit and the hydraulic pressure detected by the second hydraulic pressure detector unit, the first hydraulic pressure detector unit being connected to the first pilot flow path at a position between the first pilot pressure control unit and the first restrictor, and the second hydraulic pressure detector unit being connected to the second pilot flow path at a position between the second pilot pressure control unit and the second restrictor.

2. The working machine according to claim 1, wherein the actuator control unit is configure not to use the hydraulic pressure detected by either of the first and second hydraulic pressure detector units in order to control the actuator when the detected hydraulic pressure is equal to or less than a predetermined threshold.

3. A working machine comprising:

an actuator;

a hydraulic pump configured to discharge a hydraulic fluid;

a pump flow path connected to the hydraulic pump;

a tank configured to contain the hydraulic fluid;

first, second, and third tank flow paths connected to the tank;

an operating member;

a first pilot pressure control unit including a first pump port connected to the pump flow path, a first tank port connected to the first tank flow path, and a first supply/discharge port, the first pilot pressure control unit being configured to be switched between an output state and a discharge state in accordance with an operation of the operating member, the first pilot pressure control unit in the output state causing the hydraulic fluid to flow between the first pump port and the first supply/discharge port for outputting from the first supply/discharge port the hydraulic fluid of a pressure in accordance with an operating amount of the operating member, the first pilot pressure control unit in the discharge state causing the hydraulic fluid to flow between the first tank port and the first supply/discharge port;

a second pilot pressure control unit including a second pump port connected to the pump flow path, a second tank port connected to the first tank flow path, and a second supply/discharge port, the second pilot pressure control unit being configured to be in an output state when the first pilot pressure control unit is in the discharge state, the second pilot pressure control unit in the output state causing the hydraulic fluid to flow between the second pump port and the second supply/discharge port for outputting from the second supply/discharge port the hydraulic fluid of a pressure in accordance with the operating amount of the operating member, the second pilot pressure control unit being configured to be in a discharge state when the first pilot pressure control unit is in the output state, the second pilot pressure control unit in the discharge state causing the hydraulic fluid to flow between the second tank port and the second supply/discharge port;

a first pilot flow path connected to the first supply/discharge port and the first tank flow path;

a second pilot flow path connected to the second supply/discharge port and the first tank flow path;

a first hydraulic pressure detector unit that is connected to the first pilot flow path and configured to detect a hydraulic pressure in the first pilot flow path;

a second hydraulic pressure detector unit that is connected to the second pilot flow path and configured to detect a hydraulic pressure in the second pilot flow path;

a first restrictor disposed between the first pilot flow path and the second tank flow path;

a second restrictor disposed between the second pilot flow path and the third tank flow path; and an actuator control unit configured to control the actuator based on the hydraulic pressure detected by the first hydraulic pressure detector unit and the hydraulic pressure detected by the second hydraulic pressure detector unit, the first hydraulic pressure detector unit being connected to the first pilot flow path at a position between the first pilot pressure control unit and the first restrictor, and the second hydraulic pressure detector unit being connected to the second pilot flow path at a position between the second pilot pressure control unit and the second restrictor.

4. The working machine according to claim 3, wherein the actuator control unit is configure not to use the hydraulic pressure detected by either of the first and second hydraulic pressure detector units in order to control the actuator when the detected hydraulic pressure is equal to or less than a predetermined threshold.

* * * * *